United States Patent [19]

Moffat

[11] Patent Number: 4,640,070

[45] Date of Patent: Feb. 3, 1987

[54] METHOD OF ADDING EXTRA FLOORS ON EXISTING BUILDINGS

[76] Inventor: Ian Moffat, 71 Amelia Street, Hamilton, Ontario, L8P 2V3, Canada

[21] Appl. No.: 842,572

[22] Filed: Mar. 21, 1986

[51] Int. Cl.[4] ..... E04B 1/00; E04B 1/35

[52] U.S. Cl. ..... 52/236.3; 52/236.7; 52/236.9; 52/741

[58] Field of Search ..... 52/236.3, 236.7, 236.9, 52/234, 745, 741

[56] References Cited

U.S. PATENT DOCUMENTS

| | | | |
|---|---|---|---|
| 1,740,011 | 12/1929 | Evans | 52/234 |
| 3,744,200 | 7/1973 | Rice | 52/236.9 |
| 4,071,988 | 2/1978 | Bowes | 52/236.3 |

FOREIGN PATENT DOCUMENTS

| | | | |
|---|---|---|---|
| 1025187 | 4/1966 | United Kingdom | 52/236.9 |
| 606963 | 5/1978 | U.S.S.R. | 52/745 |

*Primary Examiner*—John E. Murtagh
*Assistant Examiner*—Caroline Dennison
*Attorney, Agent, or Firm*—Hirons, Rogers & Scott

[57] ABSTRACT

Methods of adding floors to an existing building structure without altering the exterior of the structure is described. One method involves providing additional foundations within the existing structure and supporting a plurality of internal columns upon these new foundations. The internal support columns are brought through the existing roof and a large platform truss is supported on these columns. A conventional construction skeleton is built on the platform truss and provides as many floors as is required. Another method involves building a further foundation immediately adjacent the existing structure and supporting external columns and also providing new foundations within the existing structure with internal support columns. A platform truss is supported on the external columns and the internal columns and the platform truss acts as a base for conventional construction skeleton with as many floors as required above the existing building structure.

15 Claims, 4 Drawing Figures

METHOD OF ADDING EXTRA FLOORS ON EXISTING BUILDINGS

This invention relates to a method of adding floors to existing building structures, and is particularly, but not exclusively, concerned with adding such floors to structures of historical or architectural value.

In high density urban areas, land is very expensive and it is often desirable to provide building structures with as many floors as possible to satisfy a social need for office space, living space and the like. However in many such high density urban areas there are frequently many older buildings with a relatively small number of floors and it is very desirable to be able to add floors or to build above such buildings. These buildings are often valuable sources of heritage and of considerable historical and architectural value. Thus the obvious solution of demolishing such buildings to make way for new high rise buildings with many floors is impractical and attempts to do so may result in protests and lawsuits from environmental and historical lobby groups. When these older buildings were constructed, some of them were designed to take additional floors, however this was usually intended to be no more than five floors and usually only two or three floors. This does not satisfy the requirement of providing a substantial amount of additional office or living space.

One proposed solution to this problem is to incorporate the original building structure within the new building structure by building an external support or cage around the original structure and to support a platform truss on new external columns so that the platform truss supports a subsequent construction skeleton to provide the new floors above the truss. However, using external columns has a number of important disadvantages. For example, such a new structure may obscure the original facade, and it also requires land to be available all around the existing structure. Such adjacent land is very rarely available in high density urban areas. To acquire such land and provide foundations all around the original structure, would result in considerable expense as well as engineering problems. An important disadvantage is that the appearance of the original structure is obscured and this is not desirable.

An object of the present invention is to obviate and mitigate the disadvantages associated with previous methods and to provide an improved method of adding extra floors to an existing building.

Accordingly, in one aspect of the present invention there is provided a method of adding a number of floors to an existing structure. This method comprises providing additional foundations at least within the perimeter of the original building structure, providing internal columns supported on the new foundations and bringing these columns through the roof of the original structure. A platform truss is then supported on these new columns and a plurality of floors can be added above said platform and supported thereon using conventional building construction techniques.

In a preferred method of adding new floors to an existing building structure, all of columns are within the perimeter of the original building and are brought through the roof of the original structure. The platform truss is supported on all of these internal columns. The platform can then support a conventional construction skeleton which may be made of concrete for providing additional floors on top of the existing floors.

An alternative method, where some adjacent land is available, internal columns can be provided through the original structure and a new foundation provided adjacent the original structure. External columns provided on the adjacent foundations are the same height as the internal columns. A platform truss is provided over the internal columns through the original structure and new exteral columns and a conventional construction skeleton can be mounted on the platform truss so that the floors overlie in part the original structure and the new structure.

These methods have the advantage that the original facade and appearance of the building is maintained and that the amount of land required to facilitate such method is minimal and indeed in the preferred embodiment, all construction can be done within the original perimeter of the original structure.

Other aspects of the invention are the structures when constructed by such methods.

These and other aspects of the invention will become apparent from the following description when taken in combination with the accompanying drawings in which.

Figure 1:
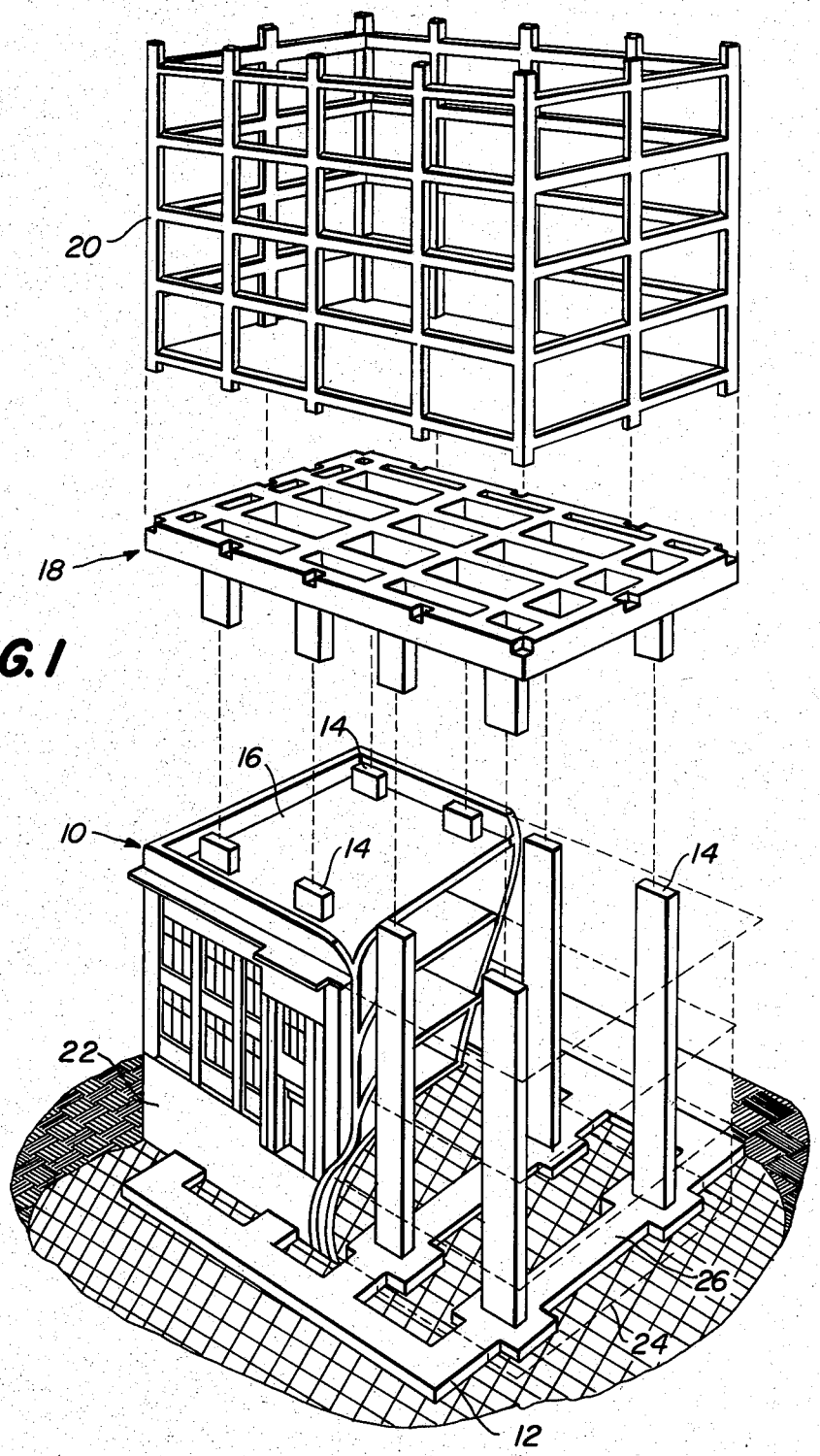
FIG. 1 is a perspective and exploded view of parts of a building to be constructed in accordance with the preferred method of construction to provide additional floors above an existing building structure.

Reference is firstly made to FIG. 1 of the drawing which shows a perspective, partly broken away and exploded view of the parts required to construct a building structure in accordance with a preferred method of construction. An existing building structure, generally indicated by reference numeral 10, is provided with an additional foundation indicated by reference number 12, which intersects the original foundation and provides a base for new internal columns 14 which rise through the interior of the building above the roof 16. A large platform truss 18, which is preferably made of steel, is supported by the columns 14 and this platform 18 supports the conventional steel skeleton 20 for providing the additional floors above the existing building structure 10.

It will be appreciated that in FIG. 1 some excavation is required around the base of the original building structure and a basement wall, indicated by reference numeral 22, requires to have access holes made for construction and to provide new foundation adjacent to the original foundation. As will be seen, the new foundation 12 intersects with the original foundation wall 24, shown in dotted outline, and underpining and cause of intersection of the new and old foundations. It will also be seen that between the walls of the original structure, a spread footing pads 26 are provided to provde a floating foundation in the trench underneath the existing foundation and basement floor. In FIG. 1, eight internal steel and concrete columns 14 are shown and it will be appreciated that the dimensions and material of these columns will be designed in accordance with conventional construction methods by persons skilled in the art and form no part of this invention.

Additionally, the steel platform truss 18 is dimensioned and designed according to conventional construction techniques in accordance with known structural requirements and the exact dimensions do not form part of this invention. However, it will be appreciated that in order for the platform to support a conventional steel skeleton 20 designed to add a significant number of floors, it should be of a sufficient depth to transmit the load of the skeleton 20 and any additional building structure through the platform 18 and the internal columns 14 to the foundations. A suitable thickness for this truss would be 10 to 16 feet high and this would depend of course on the length and breadth of the truss as well as the weight of the structure above it. Similarly, the steel skeleton will be designed in accordance with conventional techniqes and this does not form part of the present disclosure.

Figure 2:
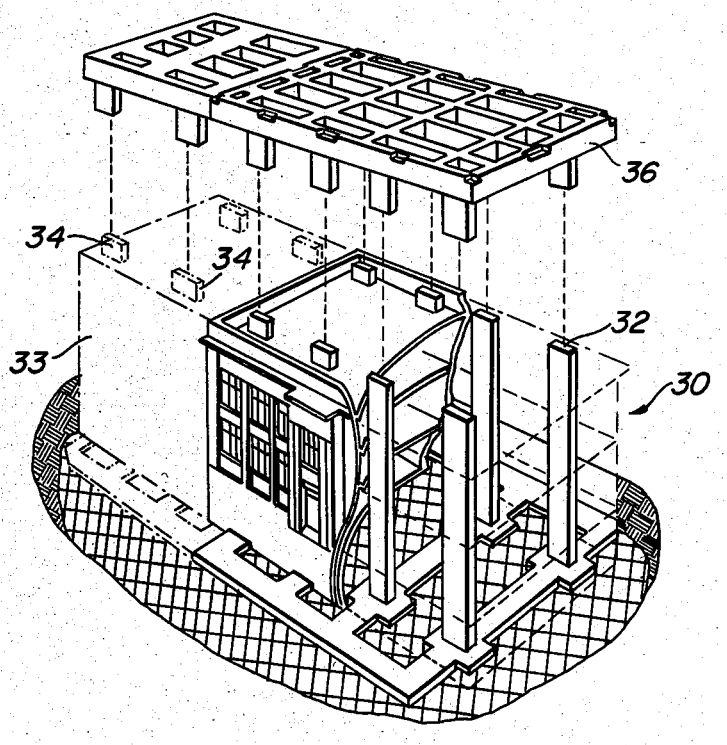
FIG. 2 is a diagrammatic and perspective view showing an alternative method of construction where the original building has some available land adjacent one side.

An alternative method of adding floors to an existing structure is shown in FIG. 2. This method is suitable when there is a piece of land available immediately adjacent to the existing structure. In this situation the existing building structure 30 has additional foundations and internal columns, generally indicated by reference number 32, extending right through the interior of the building and through the roof, in the same manner as shown in FIG. 1. The additional structure also has internal columns and these are brought up to the same height as the columns 34 extending through the existing structure. A platform 36 is positioned on the new and original building structures supported by columns 32 and 34. A steel skeleton, not shown, could be added in a similar manner to that shown in FIG. 1 but would spread across the whole of the platform above the existing building structure and the addition.

Figure 4:
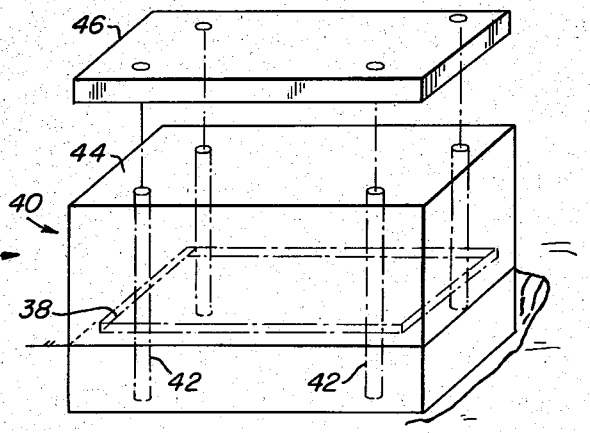
FIG. 4 is a diagrammatic view showing how the building shown in FIG. 3 can be further modified to include the platform for providing additional floors on top of the old building.
Figure 3:
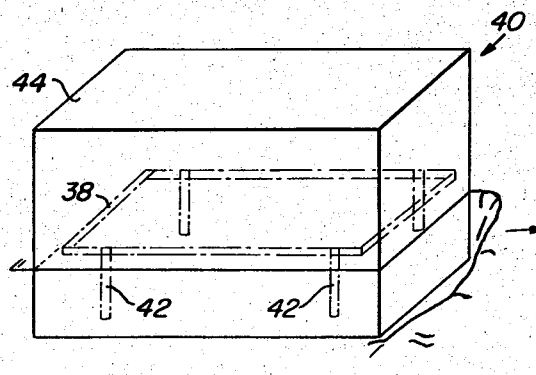
FIG. 3 is a diagrammatic perspective view in which a new intermediate floor can be located inside an old building in accordance with an alternative method according to the invention.

Reference is now made to FIGS. 3 and 4 which shows how the method can be used to provide a new intermediate floor 38 inside an existing building 40. This is particularly advantageous where the interior of the building requires to be removed or an intermediate floor provided if the building interior is very high, for example in a church or factory or the like. The advantage of this technique is that the facade and exterior of the building remain unaltered. Foundations and internal columns are provided as previously described and the new intermediate floor platform truss 38 is provided, supported on the internal columns. The columns can be brought through the truss or additional columns provided on top of the intermediate truss and brought through the roof 44 of the building. A platform truss 46 can be supported on these columns in the same manner as previously described with references to FIGS. 1 and 2, and provides the base for a construction skeleton for providing additional floors as previously described.

Without departing from the scope of the invention, it will be appreciated that there are various modifications which can be made to the method as herebefore described. For example, although eight internal support columns are shown in FIG. 1, the number of columns and size would depend on the exact structural requirements and on the type of building required to be modified and also on the size of the building. Similarly, the exact size and material of the platform truss would depend on the relative dimensions of the existing structure and the number of floors required to be added above the existing structure. Obviously the greater the number of floors, the larger the columns and the truss will be.. Although the materials for the columns and truss have been described as steel, it will apparent to those skilled in the art that a truss could be made of concrete or other suitable material in accordance with the necessary structural requirements. Furthermore, the platform could be made of steel or concrete beams instead of a truss or could be made using a continuous concrete pour. The internal and external columns could also be incorporated in load bearing walls or load bearing walls per se could be used to act as the columns.

The preferred method does not require significant adjacent land and is thus very attractive for high density urban areas where it is desired to add office or living space above and existing structure without modifying the existing facade. In situations where adjacent land does become available, then the method illustrated with reference to FIG. 2 could be used and of course the addition could be placed on either side of the building, but most preferably on the side with the least architectural significance which is least likely to modify the appearance of the existing structure.

The technique as shown in FIGS. 3 and 4 is very advantageous where a complete renovation is required inside an existing structure but the original facade must be maintained. This technique can also be very advantageously used if it is desired to add an intermediate floor to an atrium building, for example a church or a factory. It is possible to further modify the structure to add floors above it by incorporating a platform truss through which columns pass to new foundation within the original structure as has been previously described.

Advantages of this method are that the existing exterior of the building is unchanged and the historical and architectural significance is retained. A minumum of adjacent land is required, and an existing structure can easily be modified to take a significant number of floors to provide sufficient office and accomodation space as required in high density urban areas. This affords an architect with the opportunity of blending the new part of the structure with the existing structure or the other buildings in the vicinity.

Without departing form the scope of the invention it will be appreciated that alternative construction methods may be used. For example, in the case of a factory the ground floor could be modified to use as the foundation. Additional support platform trusses could be provided above the existing structure and spaced apart by support columns if the new structure requires a great number of floors.

I claim:

1. A method of adding floors above an existing building structure, said existing building structure having an existing foundation, walls supported on said existing foundation and defining a building perimeter and a roof located above said walls, said method comprising the steps of:

providing additional internal foundations, adjacent to the existing foundations and within the perimeter of the existing structure;

supporting a plurality of internal support columns on said additional internal foundations and extending said plurality of internal support columns through the roof of said existing building structure;

supporting a platform truss on said internal columns above the roof, said platform truss providing a base for a building construction skeleton framework; and building a construction skeleton above said platform truss, said construction skeleton providing a plurality of floors above said existing structure.

2. A method of adding floors above an existing building structure, said existing building structure having existing foundations, walls supported on said existing foundations said wall defining a building perimeter, and a roof located above said walls, said method comprising the steps of:

providing additional internal foundations adjacent the existing foundations within the perimeter of the building structure;

providing additional external foundations adjacent the existing foundations outside the perimeter of the existing building structure;

supporting a plurality of internal support columns on said additional internal foundations and extending said plurality of internal support colums through the roof of said existing building structure to a predetermined height;

supporting a plurality of external support columns on said additional external foundations and arranging said external support columns to be substantially the same height as the internal support columns;

supporting a platform truss on top of said external support columns and said internal support columns above said roof, said platform truss providing a base for a building construction skeleton framework;

building a construction skeleton framework above said platform truss, said construction skeleton framework providing a plurallity of floors above said existing building structure.

3. A method as claimed in claim 1 including the step of providing an intermediate floor with said existing building structure, said intermediate floor being supported on said internal support columns.

4. A method as claimed in claim 2 including the step of providing an intermediate floor with said existing building structure, said intermediate floor being supported on said internal support columns.

5. A method of adding floors above an existing building structure, said existing building structure having existing foundations, walls supported on said existing foundations, said wall defining a building perimeter, and a roof located above said walls, said method comprising the steps of;

providing additional internal foundations adjacent to existing foundations and within the perimeter of said existing structure;

supporting a plurality of internal support columns on said additional internal foundations;

supporting an intermediate floor on said internal support solumns and extending said internal support columns through the roof of said existing building structure;

supporting a platform truss on said internal columns above the roof, said platform truss providing a base for a building construction skeleton framework, and building a construction skeleton above said platform truss, said construction skeleton providing a plurality of floors above said existing structure.

6. A building structure comprising:

an existing building structure, said existing building structure having existing foundations, walls supported on said existing foundations said wall defining a building perimeter, and a roof located above said walls, and an additional internal building foundation adjacent said existing foundation;

a plurality of internal support columns mounted on said additional internal foundations, said plurality of internal supporting columns extending above said existing structure to a predetermined height;

a platform truss supported on said internal support columns above said existing building structure, said platform truss being proportioned to support an additional building structure with a plurality of floors above said existing building structure;

an construction skeleton framework supported on said platform truss, said skeleton framework providing a plurality of floors above said existing building structure.

7. A building structure as claimed in claim 1 wherein said platform truss and said internal columns are made of steel.

8. A building structure as claimed in claim 1 wherein said platform truss and said internal columns are made of concrete.

9. A building structure comprising:

an existing building structure, said existing building structure having existing foundations, walls supported on said existing foundations, said wall defining a building perimeter, and a roof located above said walls, and an additional internal building foundation adjacent said existing foundation;

a plurality of internal support columns mounted on said additional internal foundations, said plurality of internal supporting columns extending above said existing structure to a predetermined height;

an additional external foundation adjacent said existing foundation, a plurality of external support columns mounted on said external foundation, said external support columns extending to substantially the same height as the internal support columns;

a platform truss supported on said internal support columns and on said support columns above said existing building structure, said platform truss being proportioned to support an additional building structure with a plurality of floors above said existing building structure; and a construction skeleton framework supported on said platform truss said skeleton framework providing a plurality of floors above said existing building structure.

10. A building structure as claimed in claim 9 wherein said platform truss and said internal columns are made of steel.

11. A building structure as claimed in claim 9 wherein said platform truss and said internal columns are made of concrete.

12. A building structure as claimed in claim 6 wherein said existing building structure has an intermediate floor between its base and its roof supported on said internal support columns.

13. A building as claimed in claim 9 wherein said existing building structure has an intermediate floor between its base and its roof supported on said internal support columns.

14. A method of adding floors above an existing building structure, said existing building structure having an existing foundation, walls supported on said existing foundation and defining a building perimeter and a roof located above said walls, said method comprising the steps of:

providing additional foundations at least in part within the perimeter of the existing building structure supporting a plurality of support columns on said additional foundation, at least some of said plurality of columns being within said existing structure, said columns extending above said roof, supporting at least one platform truss on said acting as a base for constructing a structure having a plurality of floors above said existing building structure.

15. A building structure on an existing building structure when made by the method as claimed in claim 12.

* * * * *